US005634173A

United States Patent [19]

Kamei

[11] Patent Number: 5,634,173

[45] Date of Patent: May 27, 1997

[54] IMAGE FORMING APPARATUS CAPABLE OF CONTROLLING AMOUNT OF LIGHT OF LIGHT SOURCE

[75] Inventor: Naoyuki Kamei, Nara, Japan

[73] Assignee: Sharp Kabushiki Kaisha, Osaka, Japan

[21] Appl. No.: 557,919

[22] Filed: Nov. 14, 1995

[30] Foreign Application Priority Data

Nov. 14, 1994 [JP] Japan ..... 6-279221

[51] Int. Cl.[6] ..... G03G 15/04

[52] U.S. Cl. ..... 399/52

[58] Field of Search ..... 355/229, 228, 355/208, 68, 69, 214

[56] References Cited

U.S. PATENT DOCUMENTS

| | | | |
|---|---|---|---|
| Re. 32,330 | 1/1987 | Miyakawa et al. | 355/228 X |
| 4,124,294 | 11/1978 | Nakamura | 355/68 |
| 4,831,418 | 5/1989 | Ito et al. | 355/69 |
| 4,990,957 | 2/1991 | Nakanishi et al. | 355/228 |
| 5,336,976 | 8/1994 | Webb et al. | 355/69 X |

FOREIGN PATENT DOCUMENTS

| | | |
|---|---|---|
| 62-169182 | 7/1987 | Japan . |
| 4-263270 | 9/1992 | Japan . |
| 4-347877-A | 12/1992 | Japan . |
| 5-150622 | 6/1993 | Japan . |
| 6-014204-A | 1/1994 | Japan . |

*Primary Examiner*—Joan H. Pendegrass
*Assistant Examiner*—Sophia S. Chen
*Attorney, Agent, or Firm*—David G. Conlin; Milton Oliver

[57] ABSTRACT

In an adjustment mode, a black reference member is positioned opposite to a photosensor. Light reception data output from an A/D converter at this time is stored in a memory. In an image formation mode, based on a value obtained by subtracting output data stored in the memory from output data of the A/D converter in a state where the photosensor is opposite to an original, a copy lamp is driven. As a result, an image mode can be controlled based on an accurate detection result of an image density.

4 Claims, 6 Drawing Sheets

IMAGE FORMING APPARATUS CAPABLE OF CONTROLLING AMOUNT OF LIGHT OF LIGHT SOURCE

BACKGROUND OF THE INVENTION

1. Field of the Invention

The present invention relates to image forming apparatuses forming an image with electrophotography using light from a light source reflected from an original, such as a copying apparatus and a facsimile apparatus, and more particularly, to an image forming apparatus capable of controlling the amount of light of the light source.

2. Description of the Related Art

An image forming apparatus forming an image by irradiating an original with light from a light source and directing light reflected from the original to a photoreceptor includes a detector for detecting the amount of light (hereinafter referred to as a "light amount detector") reflected from the original. The image forming apparatus controls the amount of light of the light source based on an output signal from the light amount detector. By controlling the amount of light of the light source based on the amount of reflected light as described above, a constant image density can be obtained independent of the density of the original. In controlling the amount of light of the light source based on the amount of light reflected from the original, the characteristics of the light amount detector formed of a photodiode or the like sometimes change over time, causing output signals for the same amount of input light to vary. If no adjustment is made to such output signal variation, the image density cannot be maintained appropriately. Manual adjustment of the level of the output signal of the light amount detector is troublesome.

FIG. 8 shows a structure of a light amount control portion of a conventional image forming apparatus disclosed in Japanese Patent Laying-Open No. 4-347877. As shown in FIG. 8, light of a light source 81 is directed to an adjustment pattern 82. A control portion 85 controls an electrically controlled volume 84 so that an output signal from a light amount detector 83 in receiving light reflected from adjustment pattern 82 is within a predetermined range. By being thus structured, the image forming apparatus can adjust the level of the output signal of light amount detector 83 receiving light reflected from adjustment pattern 82 of a constant density to a predetermined value even when the characteristics of light amount detector 83 change over time.

However, no conventional image forming apparatus took into consideration incidence of light of the light source on the light amount detector after reflection from a member other than the original, or direct incidence of light of the light source on the light amount detector. Such light other than light reflected from the original is incident on the light amount detector both in a copy mode and in an adjustment mode to act as bias light to the total amount of light received by the light amount detector. The amount of the light other than light reflected from the original changes according to the amount of light of the light source. Therefore, when the amount of light of the light source changes due to attachment of scattered toner, paper pieces, or dust to the light source, it is not possible to correct variation of the level of the output signal of the light amount detector influenced by the light other than the light reflected from the original only by adjusting the output signal of the light amount detector to be within a predetermined range in the adjustment mode, making it impossible to maintain a favorable image formation state.

SUMMARY OF THE INVENTION

One object of the present invention is to provide an image forming apparatus capable of always maintaining a favorable image formation state.

Another object of the present invention is to control the amount of light of a light source accurately in an image forming apparatus.

Still another object of the present invention is to provide an image forming apparatus capable of detecting an original density accurately even when the amount of light of a light source changes.

The above objects of the present invention can be achieved by an image forming apparatus having the following components. More specifically, the image forming apparatus according to the present invention includes a light source exposing an original, an image forming unit forming an image based on light from the light source reflected from the original, a first light amount detector for detecting the amount of first light reflected from the original, a second light amount detector for detecting the amount of second light reflected from a reference original having a reference density, a corrector for correcting an output from the first light amount detector with an output from the second light amount detector, and a controller for controlling the amount of light of the light source with an output from the corrector.

Since the intensity of the light source is controlled by a signal obtained by correcting the amount of light reflected from the original detected by the first light amount detector with the amount of light reflected from the reference original having a predetermined reference density, the amount of light of the light source is controlled only by light reflected from the original. As a result, an image forming apparatus can be provided which can eliminate the influence of change over time of the amount of light of a copy lamp and of an attachment error of the light amount detector or the like to always maintain a favorable image formation state.

Preferably, the image forming apparatus includes an adjustment mode before image formation and an image formation mode, and the first light amount detector operates during the adjustment mode.

The image forming apparatus has the image formation mode and the adjustment mode before image formation, and correction data is obtained in the adjustment mode. By preparing the correction data in advance, a favorable image can be formed in a shorter time in the image forming apparatus.

Preferably, the image forming apparatus includes a memory for storing detection data of the first light amount detector during the adjustment mode. Since correction data is stored in the memory in advance during the adjustment mode, a signal level for controlling the intensity of the light source can be obtained easily.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
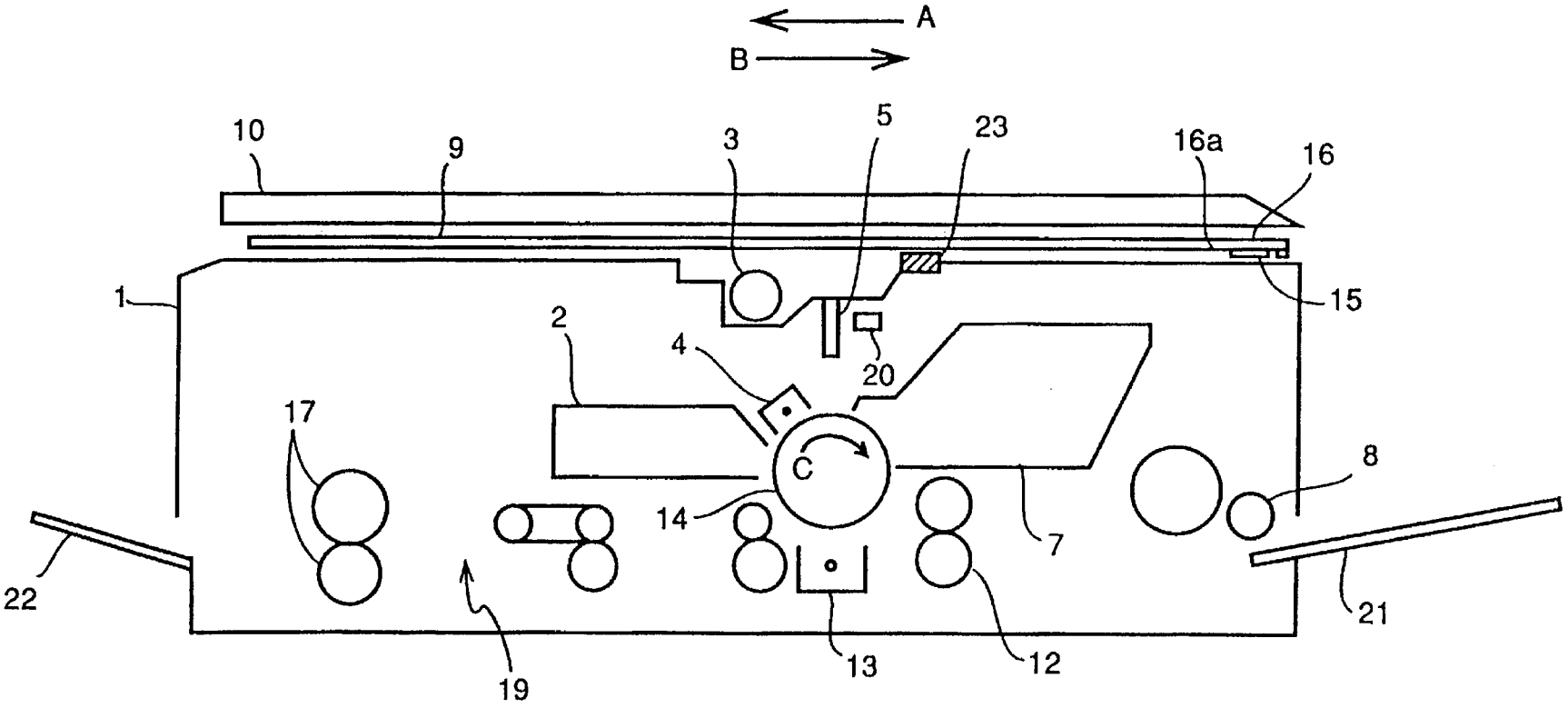
FIG. 1 is a schematic diagram showing a structure of a copying apparatus which is one embodiment of the present invention.

Referring to FIG. 1, a copying apparatus according to one embodiment of the present invention is a platen mobile type copying apparatus in which a platen 9 positioned at the upper surface of a body 1 reciprocates in the directions indicated by arrows A and B together with an original cover 10. A paper feed tray 21 is mounted at one side of body 1, and a paper discharge tray 22 is mounted at the other side of body 1. A photoreceptor drum 14 is rotatably supported approximately at the center portion in body 1. Around photoreceptor drum 14, a corona charger 4, a developing device 7, a transfer charger 13, and a cleaner 2 are arranged opposite to each other.

A copy lamp 3 and a condenser lens 5 constituting an optical system are provided in the upper portion of body 1. In body 1, a paper transport path 19 from paper feed tray 21 to paper discharge tray 22 through a space between photoreceptor drum 14 and transfer charger 13 is constituted of a paper feed roller 8 and a Paper Start roller (PS roller) 12. PS roller 12 synchronizes position of the image formed on the drum 14 and the position of the paper. A fixation roller 17 is provided in paper transport path 19 between photoreceptor drum 14 and paper discharge tray 22.

In the copying apparatus structured as described above, an original is mounted on platen 9, and papersheets are placed on paper feed tray 21. When a copy switch is operated in this state, a copying process is started. In the copying process, platen 9 on which the original is mounted moves to its home position in the direction indicated by arrow A together with original cover 10. At this home position, an original reference line 16*a* which is a boundary between an original reference plate 16 and platen 9 is opposite to condenser lens 5. According to this movement, a papersheet on paper feed tray 21 is fed to PS roller 12 by rotation of paper feed roller 8 and the like. Note that a black reference member 15 which is irradiated with light from copy lamp 3 in an adjustment mode to be described later is affixed to the bottom surface of original reference plate 16.

After that, corona charger 4 is driven and photoreceptor drum 14 rotates in the direction indicated by arrow C. Copy lamp 3 is lit, and platen 9 moves in the direction indicated by arrow B. This movement causes the original mounted on platen 9 to be scanned by light of copy lamp 3, and light reflected from the original is directed to photoreceptor drum 14 after charged through condenser lens 5. By the light reflected from the original being directed to photoreceptor drum 14, an electrostatic latent image is formed on the surface of photoreceptor drum 14. Toner is supplied to the surface of photoreceptor drum 14 on which the electrostatic latent image is formed from developing device 7, to develop the electrostatic latent image.

PS roller 12 is driven in synchronism with rotation of photoreceptor drum 14 in the direction indicated by arrow C, and the papersheet is introduced between photoreceptor drum 14 and transfer charger 13. The toner image developed on photoreceptor drum 14 is transferred onto the papersheet by transfer charger 13. The papersheet onto which the toner is transferred is introduced by fixation roller 17. After being heated and pressurized, the toner image is melted and fixed on the papersheet. After that, the papersheet is discharged onto paper discharge tray 22.

Figure 2:
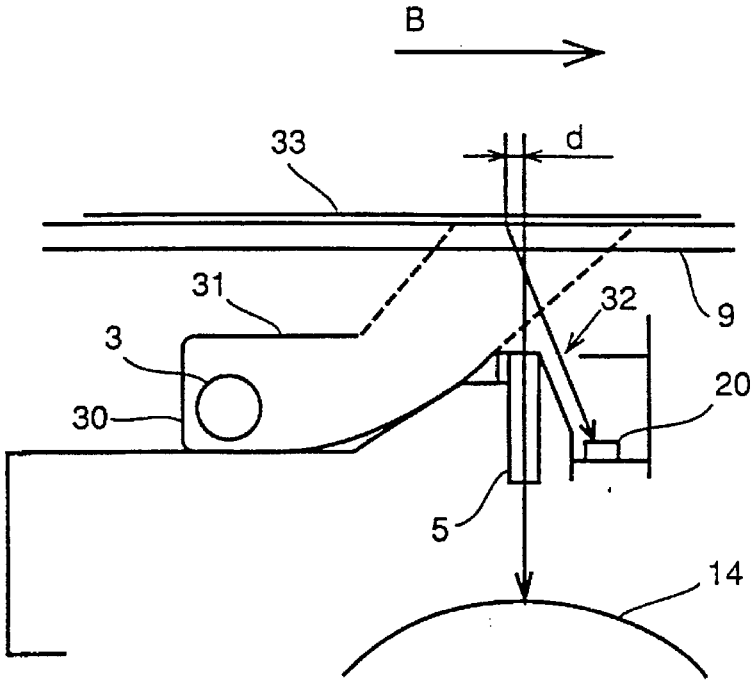
FIG. 2 is a diagram showing a structure in the vicinity of an optical system device in the copying apparatus.

Referring to FIG. 2, copy lamp 3 is placed in a reflector 30, 31. The light of copy lamp 3 is directed to an original 33 placed on platen 9 by reflector 30. Condenser lens 5 is arranged in the normal direction of photoreceptor drum 14, so that light reflected from a portion of original 33 positioned in the normal direction of photoreceptor 14 is directed to the surface of photoreceptor 14 through condenser lens 5. Light reflected from another portion of original 33 moving together with platen 9 in the direction indicated by arrow B, which is a distance d before the position at which reflected light is directed to photoreceptor 14 in the direction of movement of original 33, is directed to a photosensor 20 arranged in the vicinity of condenser lens 5 through a slit 32.

Figure 3:
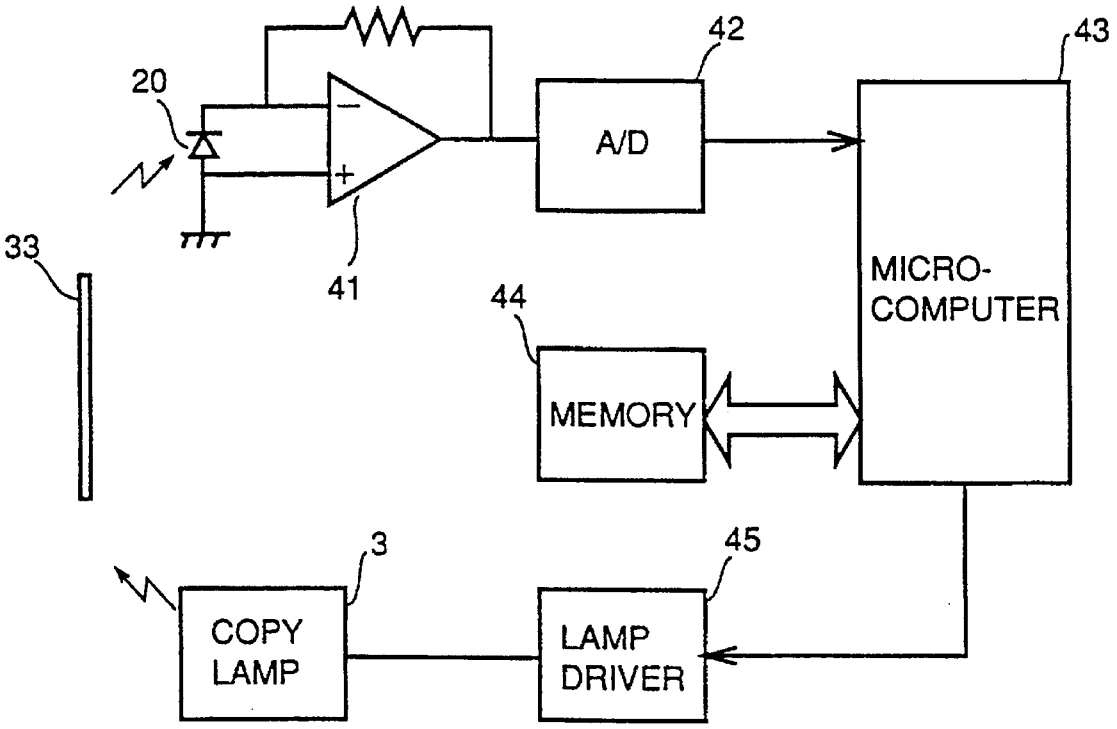
FIG. 3 is a block diagram showing a structure of a main portion of the copying apparatus.

Referring to FIG. 3, after being amplified by a reversing and amplifying circuit 41, an output signal of photosensor 20 is converted into digital data by an A/D converter 42, and applied to a microcomputer 43. Based on data stored in a memory 44 and data input from A/D converter 42, microcomputer 43 provides control data, according to an image density of original 33 detected by photosensor 20, to a lamp driver 45. Lamp driver 45 controls copy lamp 3 based on the control data input from microcomputer 43 in pulse width modulation, and drives copy lamp 3 so that copy lamp 3 emits the amount of light according to the image density detected by photosensor 20.

The distance d shown in FIG. 2 is obtained by multiplying a time, from reception of light reflected from original 33 by photosensor 20 to emission by copy lamp 3 of light of the amount according to the output signal of photosensor 20, by a moving speed of original 33. As described above, the image density at a position before the position in the direction of movement of original 33 at which reflected light is incident on photoreceptor drum 14 is detected in advance by photosensor 20, and light reflected from original 33 of light of the amount according to the image density is directed to photoreceptor drum 14 through condenser lens 5.

Figure 4:
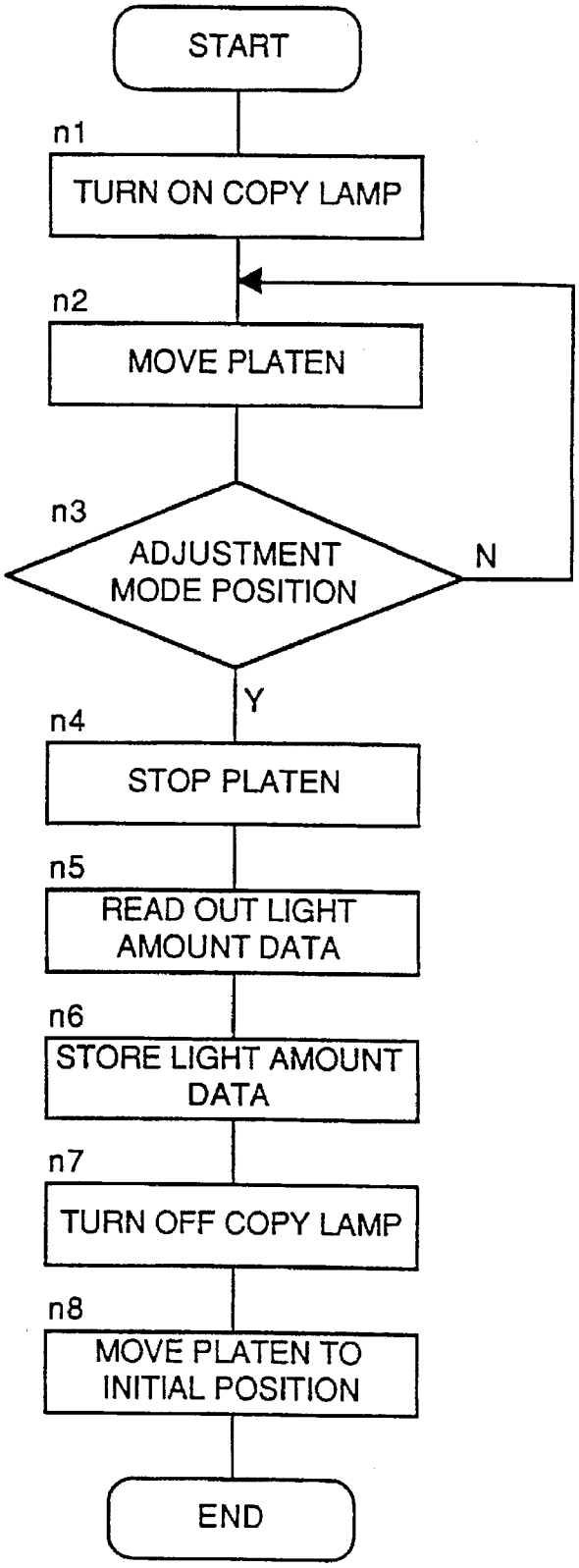
FIG. 4 is a flow chart showing a part of processing procedures of a control portion of the copying apparatus.

Referring to FIG. 4, after driving copy lamp 3, microcomputer 43 moves platen 9 to an adjustment mode position in the direction indicated by arrow A (steps n2 to n4 in FIG. 4; in the following description, the term "step" is omitted). The adjustment mode means a condition wherein light amount data of photosensor 20 is detected and the same is converted to ideal light amount data. In this adjustment mode position, black reference member 15 affixed to the bottom surface of original reference plate 16 is opposite photosensor 20 with slit 23 shown in FIG. 2 therebetween. Microcomputer 43 reads out light amount data at this time from A/D converter 42 (n5), and stores the data in memory 44 (n6). Then, microcomputer 43 turns off copy lamp 3, and moves platen 9 to its initial position (n8). Note that whether or not platen 9 reaches the adjustment mode position is detected by detection of a protrusion provided at the bottom surface of original reference plate 16 by a switch 23 provided at the same position as the upper surface of body 1 to which photosensor 20 is opposite with slit 32 therebetween in the direction of movement of platen 9.

The light amount data output from A/D converter 42 in the adjustment mode is preferably 0, since reference member 15 reflecting light of copy lamp 3 is a black non-reflective member. However, the output signal of photosensor 20 in the adjustment mode is not 0 actually because of reflection of light of copy lamp 3 from a portion other than reference member 15, reception by photosensor 20 of light of copy lamp 3 directly incident on photosensor 20, and an attachment error of photosensor 20 and a difference among individual photosensors. As a result, light amount data X in the adjustment mode has influence on the output of photosensor 20 in the image formation mode as a bias value.

Among factors causing the output signal not to be 0, the attachment error of photosensor 20 and the difference among individual photosensors are approximately constant independent of applied voltage to copy lamp 3. The amount of light of copy lamp 3 reflected from a portion other than reference member 15 and the amount of light directly incident on photosensor 20 and received by photosensor 20 are proportional to the applied voltage to copy lamp 3. Therefore, when Y denotes light amount data detected by photosensor 20 in the image formation mode, and K denotes a proportional constant between light amount data on light of copy lamp 3 other than light reflected from the original and applied voltage V, an absolute density Z of the original is obtained by the following expression:

$$Z=Y-(X+K\cdot V)$$

Figure 5:
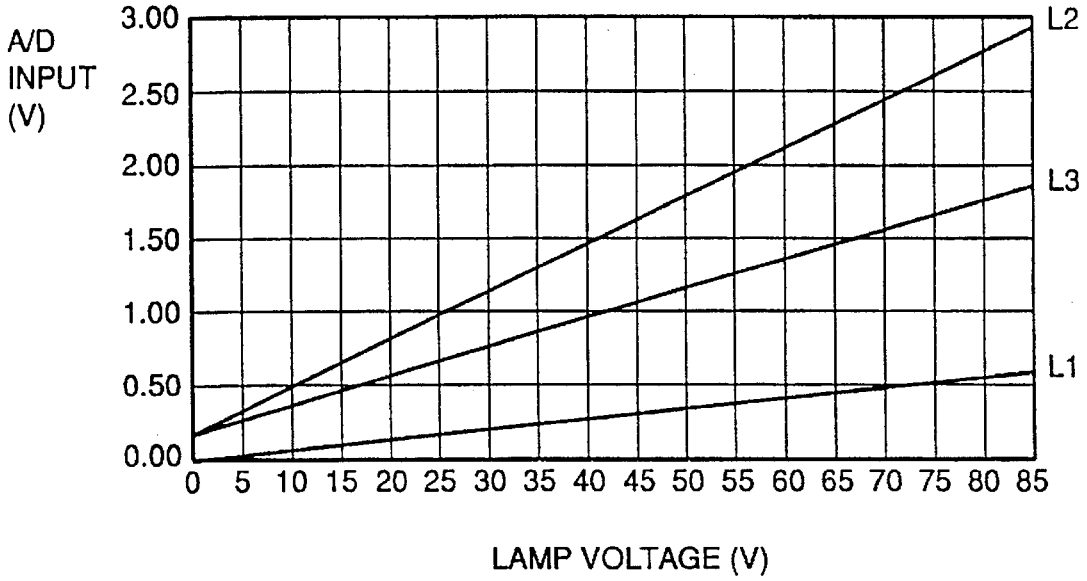
FIG. 5 is a diagram showing the relationship among light amount data in an image formation mode, light amount data in an adjustment mode, and true light amount data in the copying apparatus.
Figure 8:
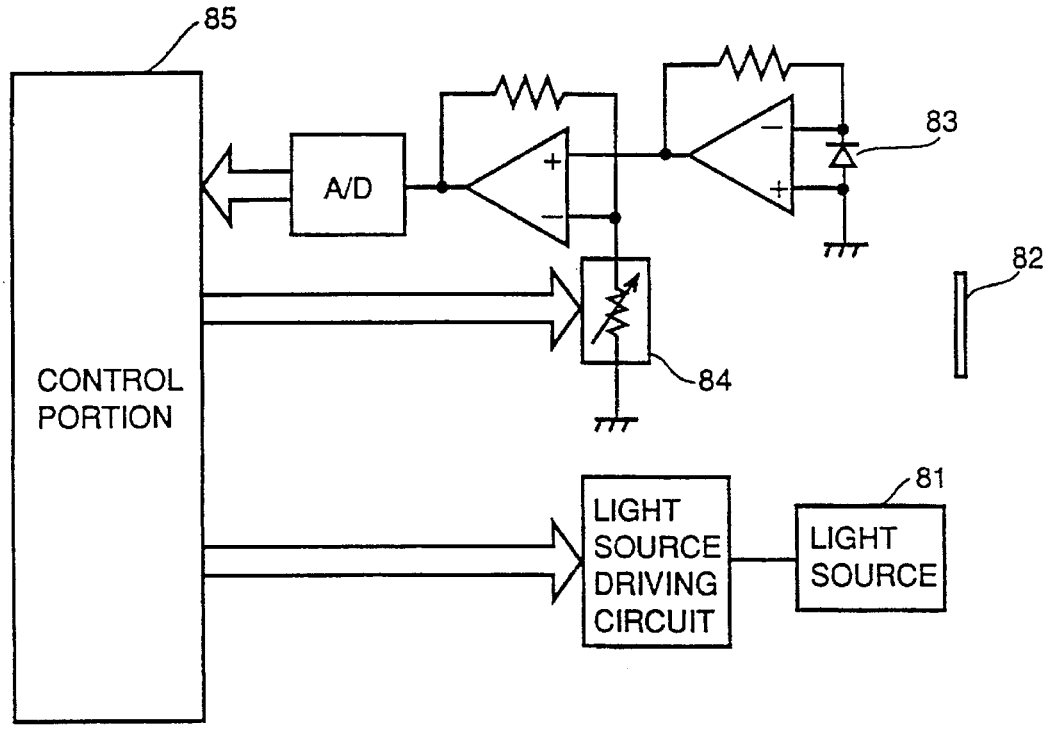
FIG. 8 PRIOR ART
FIG. 8 is a diagram showing a structure of a conventional image forming apparatus.

FIG. 5 shows the relationship among light amount data detected by the photosensor in the image formation mode, light amount data detected by the photosensor in the adjustment mode, and ideal light amount data of the photosensor when receiving light reflected from an original having a specific density. The relationship between the light amount data detected by photosensor 20 when receiving light reflected from the original having a specific image density and the voltage applied to the copy lamp is indicated by a linear line L1. More specifically, as voltage applied to copy lamp 3 increases, the amount of light of copy lamp 3 increases, and the amount of light received by photosensor 20 also increases.

On the other hand, when voltage applied to copy lamp 3 is 0, light is not emitted from copy lamp 3. Light amount data detected by photosensor 20 should also be 0. In order to maintain a favorable image formation state in the image formation mode, copy lamp 3 should be driven based on such ideal light amount data shown by linear line L1. However, light amount data actually detected by photosensor 20 in the image formation mode is affected by light of copy lamp 3 other than light reflected from the original, an attachment error of photosensor 20, and a difference among individual photosensors. The relationship between the voltage applied to copy lamp 3 and the light amount data detected by photosensor 20 is as shown by a linear line L2.

In the present invention, light amount data of photosensor 20 when light of copy lamp 3 is directed to black reference member 15 in the adjustment mode is found in advance. By subtracting light amount data of photosensor 20 in the adjustment mode positioned on a linear line L3 from light amount data of photosensor 20 in the image formation mode positioned on linear line L2, ideal light amount data on linear line L1 is obtained.

For example, assume that light amount data when 60 V is applied to copy lamp 3 in the adjustment mode is D2, and that light amount data when 70 V is applied to copy lamp 3 in the image formation mode is D1. Ideal light amount data Z can be obtained by the following expression:

$$Z=D1-\{D2+K(70-60)\}$$

Microcomputer 43 performs the above described calculation in the image formation mode, and obtains control data for copy lamp 3 based on the obtained ideal light amount data Z.

Note that change of proportional constant K of linear line L3 over time is negligibly small in general. The change can be measured at the time of shipping from the factory, and set in microcomputer 43. When change of proportional constant K over time is not negligible, the value of proportional constant K can be obtained based on light amount data when a plurality of voltages are applied to copy lamp 3 in the adjustment mode.

Figure 6:
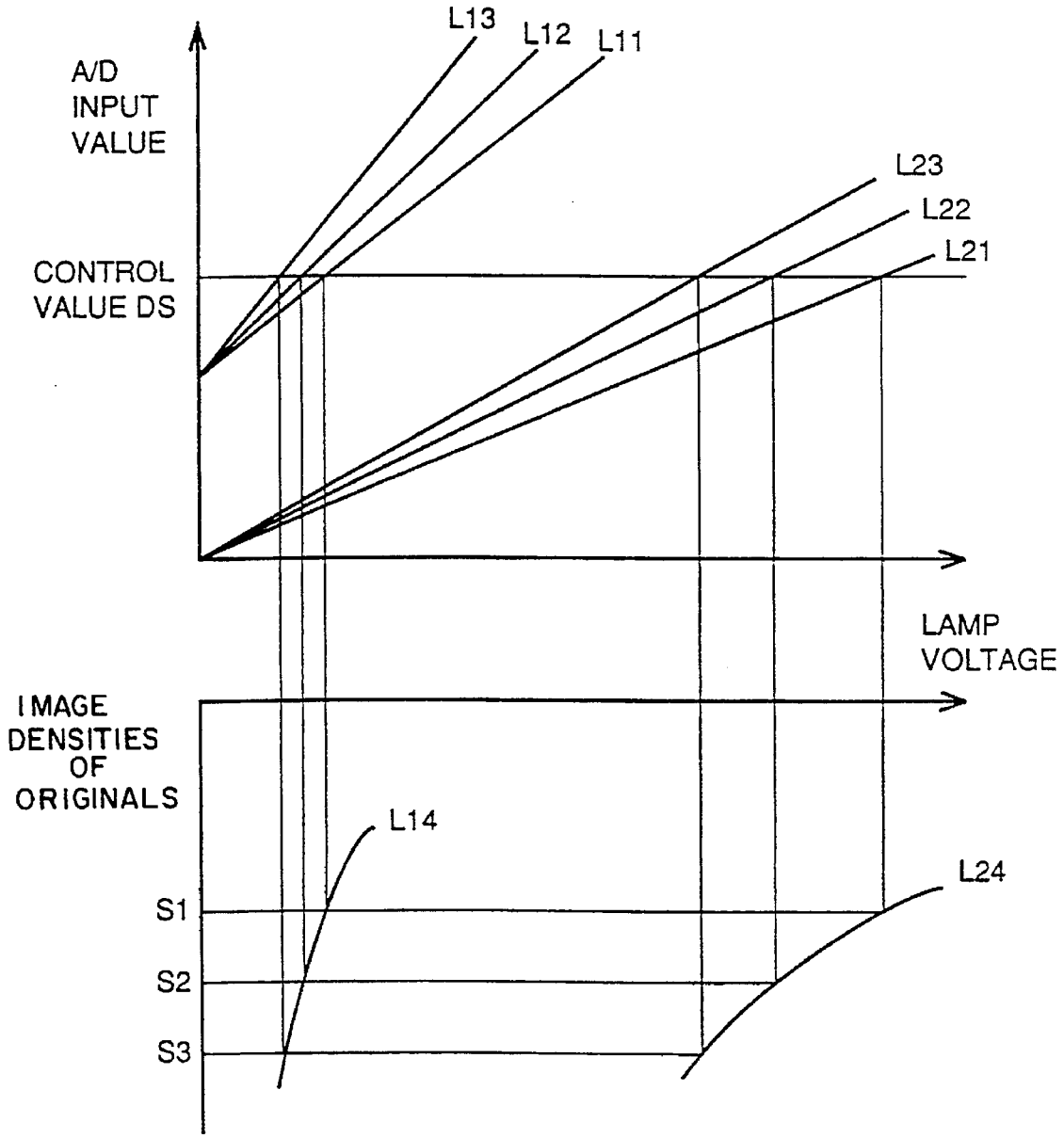
FIG. 6 is a diagram showing light amount data in the image formation mode and the relationship between a density of an original and a driving voltage of a copy lamp.

FIG. 6 shows a control state of an image density in the image formation mode in the copying apparatus of the present invention. Referring to FIG. 6, the relationship, between light amount data on originals having three kinds of image densities of S1<S2<S3 and voltage applied to the copy lamp, is indicated by L11 to L13. When it is intended to control the voltage applied to the copy lamp using the light amount data so that the light amount data becomes a control value DS of the amount of light of the light source, the voltage applied to the copy lamp is changed for image densities S1 to S3 along the gradient shown by a curve L14. On the other hand, in the present invention, the relationship between the light amount data and the voltage applied to the copy lamp is corrected as shown by linear lines L21 to L23. Therefore, the voltage applied to the copy lamp is changed for image densities S1 to S3 along the gradient shown by a curve L24. The dynamic range becomes larger than the case shown by curve L14, allowing more meticulous control of the image density.

It is also possible to calculate in advance the relationship of linear line L3 shown in FIG. 5 based on the obtained light amount data in the adjustment mode, and to store the relationship in memory 44. In this case, by reading out correction data corresponding to the lamp voltage at that time from the relationship of linear line L3 stored in memory 44 and subtracting the data from the light amount data in the image formation mode, true light amount data can be obtained in the normal image formation mode.

The processing of the above described adjustment mode can be carried out after completing initialization and before entering a stand-by state whenever body 1 of the copying apparatus is supplied with power. The processing of the adjustment mode may be carried out whenever a predetermined number of papersheets are copied. Further, an indication may be given that the copying process is inhibited during the processing of the adjustment mode.

Figure 7:
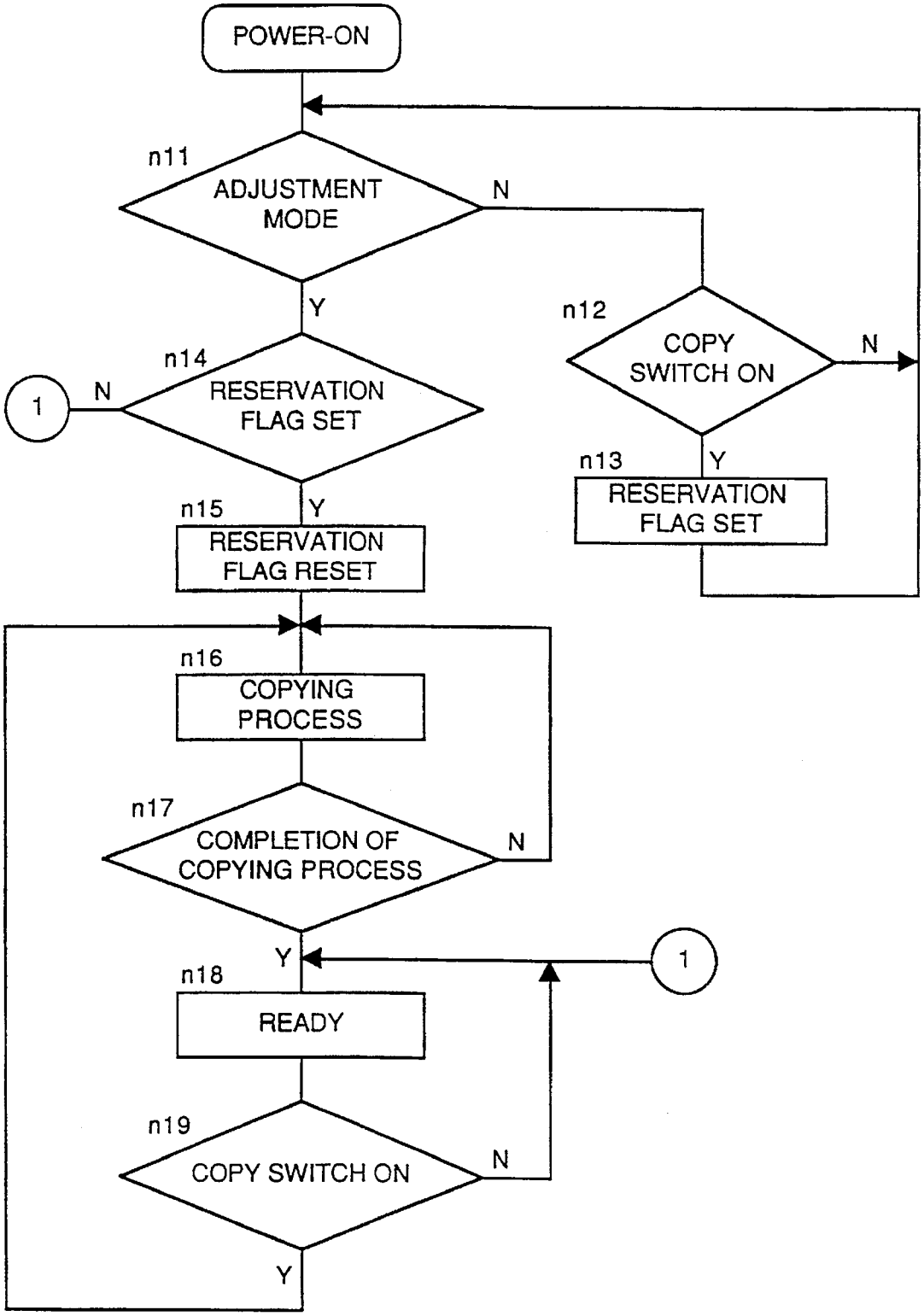
FIG. 7 is a flow chart showing a part of processing procedures of a copying apparatus according to another embodiment of the present invention.

Alternately, a reservation for the copying process may be accepted by operation of a copy switch during the processing of the adjustment mode, so that the copying process according to the reservation should be carried out after completion of the adjustment mode. In this case, whether or not the copy switch is operated is checked during the processing of the adjustment mode as shown in FIG. 7. When the copy switch is operated, a reservation flag is set (n11 to n13). When the processing of the adjustment mode is completed, the content of the reservation flag is determined (n14). When the reservation flag is set, the flag is reset and the copying process is carried out (n15 and n16). When the copying process according to the reservation is completed, the copying apparatus enters the stand-by state, and waits for an instruction of the next copying process by operation of the copy switch (n17 to n19).

Further, the processing of the adjustment mode may be carried out when a key operation according to a predetermined combination is carried out while the copying apparatus waits for the next copying process. Further, instruction input of the processing of the adjustment mode by the operator may be accepted only at a predetermined temperature or less at which a fixing device cannot carry out the copying process.

In the above embodiment, an example of a copying apparatus moving a platen was described. However, the copying apparatus may move a copy lamp or an optical system.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image forming apparatus, comprising:

a light source exposing an original;

image forming means for forming an image based on light from said light source reflected from said original;

first light amount detecting means for detecting the amount of first light reflected from said original;

second light amount detecting means for detecting the amount of second light reflected from a black reference original having a reference density;

means, for correcting an output from said first light amount detecting means with an output from said second light amount detecting means, including a memory storing a relationship between correction data of said correcting means and driving voltage of said light source; and means for controlling the amount of light of said light source with an output of said correcting means.

2. The image forming apparatus according to claim 1, wherein said image forming apparatus is operated in two modes of an adjustment mode before image formation and an image formation mode, and said first light amount detecting means, said second light amount detecting means, and said correcting means are operated in said adjustment mode.

3. The image forming apparatus according to claim 2, wherein said control means controls the amount of light of said light source based on the correction data stored in said memory in said image formation mode.

4. The image forming apparatus according to claim 1, wherein said first light amount detecting means comprises said second light amount detecting means.

* * * * *